US011149511B2

(12) United States Patent
Cridland et al.

(10) Patent No.: US 11,149,511 B2
(45) Date of Patent: Oct. 19, 2021

(54) SEAL ASSEMBLY RUNNING TOOLS AND METHODS

(71) Applicant: CAMERON INTERNATIONAL CORPORATION, Houston, TX (US)

(72) Inventors: Robert Cridland, Leeds (GB); Gavin Robottom, Leeds (GB)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 30 days.

(21) Appl. No.: 15/476,403

(22) Filed: Mar. 31, 2017

(65) Prior Publication Data

US 2018/0283114 A1 Oct. 4, 2018

(51) Int. Cl.
*E21B 33/03* (2006.01)
*E21B 23/00* (2006.01)

(52) U.S. Cl.
CPC ..... *E21B 33/03* (2013.01); *E21B 23/00* (2013.01)

(58) Field of Classification Search
CPC ..... E21B 33/04
See application file for complete search history.

(56) References Cited

U.S. PATENT DOCUMENTS 3,357,486 A * 12/1967 Brown ..... E21B 33/043 166/208
3,468,559 A * 9/1969 Ahlstone ..... E21B 33/043 285/18
3,901,546 A * 8/1975 Piazza ..... E21B 33/04 294/86.15
4,067,388 A * 1/1978 Mouret ..... E21B 23/04 166/208
4,234,043 A * 11/1980 Roberts ..... E21B 33/0355 137/236.1
5,044,442 A 9/1991 Nobileau
5,404,955 A * 4/1995 Echols, III ..... E21B 23/00 166/122
5,735,344 A * 4/1998 Duncan ..... E21B 33/04 166/115
7,096,956 B2 8/2006 Reimert
2014/0166298 A1* 6/2014 Fenwick ..... E21B 23/00 166/360
2014/0251630 A1* 9/2014 Reimert ..... E21B 33/043 166/335

FOREIGN PATENT DOCUMENTS

CA 2568105 A1 4/2008

* cited by examiner

*Primary Examiner* — Steven A Macdonald
(74) *Attorney, Agent, or Firm* — Helene Raybaud

(57) ABSTRACT

A running tool assembly for installing a seal assembly in a wellhead housing includes a mandrel configured to couple with a conveyance string and including a central passage, a first piston slidably disposed about the mandrel and configured to releasably couple with the seal assembly, and a second piston slidably disposed in the central passage of the mandrel and including an annular seal that sealingly engages an inner surface of the central passage, wherein, when the running tool assembly is disposed in the wellhead housing, the second piston is configured to set an axially settable component in response to a pressurization of the central passage of the mandrel.

20 Claims, 10 Drawing Sheets

SEAL ASSEMBLY RUNNING TOOLS AND METHODS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon well systems require various components to access and extract hydrocarbons from subterranean earthen formations. Such systems may include a wellhead assembly through which the hydrocarbons, such as oil and natural gas, are extracted. The wellhead assembly may include a variety of components, such as valves, fluid conduits, controls, casings, hangers, and the like to control drilling and/or extraction operations. In some operations, hangers, such as tubing or casing hangers, may be used to suspend strings (e.g., piping for various fluid flows into and out of the well) in the well. Such hangers may be disposed or received in a housing, spool, or bowl. In addition to suspending strings inside the wellhead assembly, the hangers provide sealing to seal the interior of the wellhead assembly and strings from pressure inside the wellhead assembly.

In some applications, a hanger, such as a tubing hanger, is installed in the wellhead assembly via a running tool releasably coupled to the tubing hanger. The tubing hanger and running tool may be lowered towards the wellhead via a tubular string until the hanger is landed within the wellhead. In some applications, the running tool may also transport seal assemblies, locking members, and other accoutrements of the tubing hanger for installation within the wellhead for sealing and securing the tubing hanger therein. Additionally, the tubing hanger may include passages for the running of control lines downhole to control components and monitor conditions in a wellbore of the well system.

SUMMARY

An embodiment of a running tool assembly for installing a seal assembly in a wellhead housing comprises a mandrel configured to couple with a conveyance string and comprising a central passage, a first piston slidably disposed about the mandrel and configured to releasably couple with the seal assembly, and a second piston slidably disposed in the central passage of the mandrel and comprising an annular seal that sealingly engages an inner surface of the central passage, wherein, when the running tool assembly is disposed in the wellhead housing, the second piston is configured to set an axially settable component in response to a pressurization of the central passage of the mandrel. In some embodiments, the axially settable component comprises a lock ring configured to lock the seal assembly in position. In some embodiments, when the running tool is disposed in the wellhead housing and the first piston is coupled to the seal assembly, the first piston is configured to energize the seal assembly in response to a pressurization of an end of the first piston. In certain embodiments, the running tool assembly further comprises a sleeve coupled to the second piston and configured to apply an axially directed force against the axially settable component when the running tool assembly is disposed in the wellhead housing. In certain embodiments, the running tool assembly further comprises a flowby passage extending axially through the mandrel and radially offset from the central passage of the mandrel. In some embodiments, when the running tool assembly is disposed in the wellhead housing the first piston is configured to sealingly engage an inner surface of the wellhead housing and an outer surface of the mandrel, and the flowby passage is configured to provide fluid communication between an upper end of the mandrel and a lower end of the mandrel. In some embodiments, the running tool assembly further comprises a landing plate slidably disposed in the central passage of the mandrel and comprising a first position permitting fluid flow through the flowby passage and a second position restricting fluid flow through the flowby passage. In certain embodiments, the running tool assembly further comprises a shear pin configured to retain the landing plate in the first position, wherein the landing plate is configured to shear the shear pin in response to landing against a component disposed in the wellhead housing. In certain embodiments, the running tool assembly further comprises a shear assembly that comprises a housing, a cartridge slidably disposed in the housing, and the shear pin, wherein the shear pin is coupled to the housing, wherein the running tool assembly has a central axis and the cartridge is configured to translate an axially directed force into a radially directed force in response to physical engagement between the landing plate and a profiled end of the cartridge.

An embodiment of a running tool assembly for installing a seal assembly in a wellhead housing comprises a mandrel configured to couple with a conveyance string, and a first piston slidably disposed about the mandrel and configured to releasably couple with the seal assembly, wherein, when the running tool is disposed in the wellhead housing and the first piston is coupled to the seal assembly, the first piston is configured to energize the seal assembly in response to a pressurization of an end of the first piston. In some embodiments, the running tool assembly further comprises a shear pin coupling the first piston to the mandrel to restrict relative axial movement therebetween, wherein the shear pin is configured to shear in response to the pressurization of the end of the first piston. In some embodiments, the running tool assembly further comprises an anti-rotation key extending from an outer surface of the mandrel, wherein the anti-rotation key is received in a slot of the first piston. In certain embodiments, the anti-rotation key is configured to restrict relative rotation while allowing limited relative axial movement between the mandrel and the first piston. In certain embodiments, the first piston comprises a first seal sealing against an outer surface of the mandrel and a second seal configured to seal against an inner surface of the wellhead housing when the running tool is disposed in the wellhead housing. In some embodiments, the first and second seals of the first piston are configured to restrict fluid flow across the running tool assembly when the running tool assembly is disposed in the wellhead housing and the end of the first piston is pressurized. In some embodiments, the running tool assembly further comprises a second piston slidably disposed in the central passage of the mandrel and comprising an annular seal that sealingly engages an inner surface of the central passage, wherein, when the running tool assembly is disposed in the wellhead housing, the second piston is configured to set an axially settable component in response to a pressurization of the central passage of the mandrel.

An embodiment of a method of installing a seal assembly in a wellhead housing comprises coupling a seal assembly to a running tool, running the running tool into a wellhead housing using a conveyance string, actuating a blowout preventer to seal against the conveyance string, and pressurizing an end of a first piston of the running tool to energize the seal assembly. In some embodiments, the method further comprises shearing a shear pin restricting relative axial movement between the first piston and a mandrel of the running tool that is coupled to the conveyance string in response to pressurizing the end of the first piston. In some embodiments, the method further comprises pressurizing a central passage of a mandrel of the running tool that is coupled to the conveyance string, displacing a second piston disposed in the central passage from a first position to a second position in response to pressurizing the passage, and setting an actuatable tool in response to displacing the second piston from the first position to the second position. In certain embodiments, the method further comprises flowing a fluid through a flowby passage extending through a mandrel of the running tool that is coupled to the conveyance string to prevent hydraulic lock from occurring in the wellhead housing as the running tool is displaced therein.

BRIEF DESCRIPTION OF THE DRAWINGS

For a detailed description of exemplary embodiments, reference will now be made to the accompanying drawings in which.

DETAILED DESCRIPTION

Figure 1:
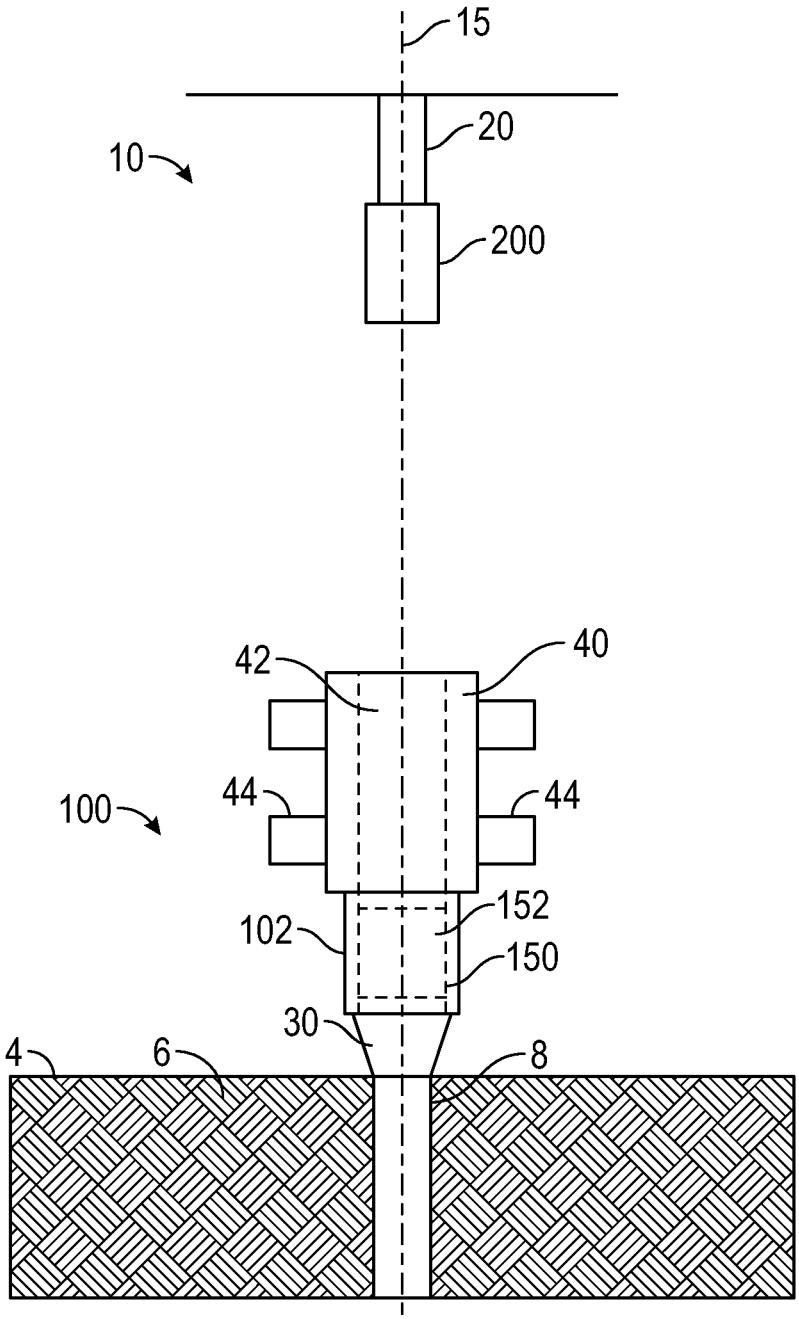
FIG. 1 is a schematic view of an embodiment of a well system in accordance with principles disclosed herein.
Figure 2:
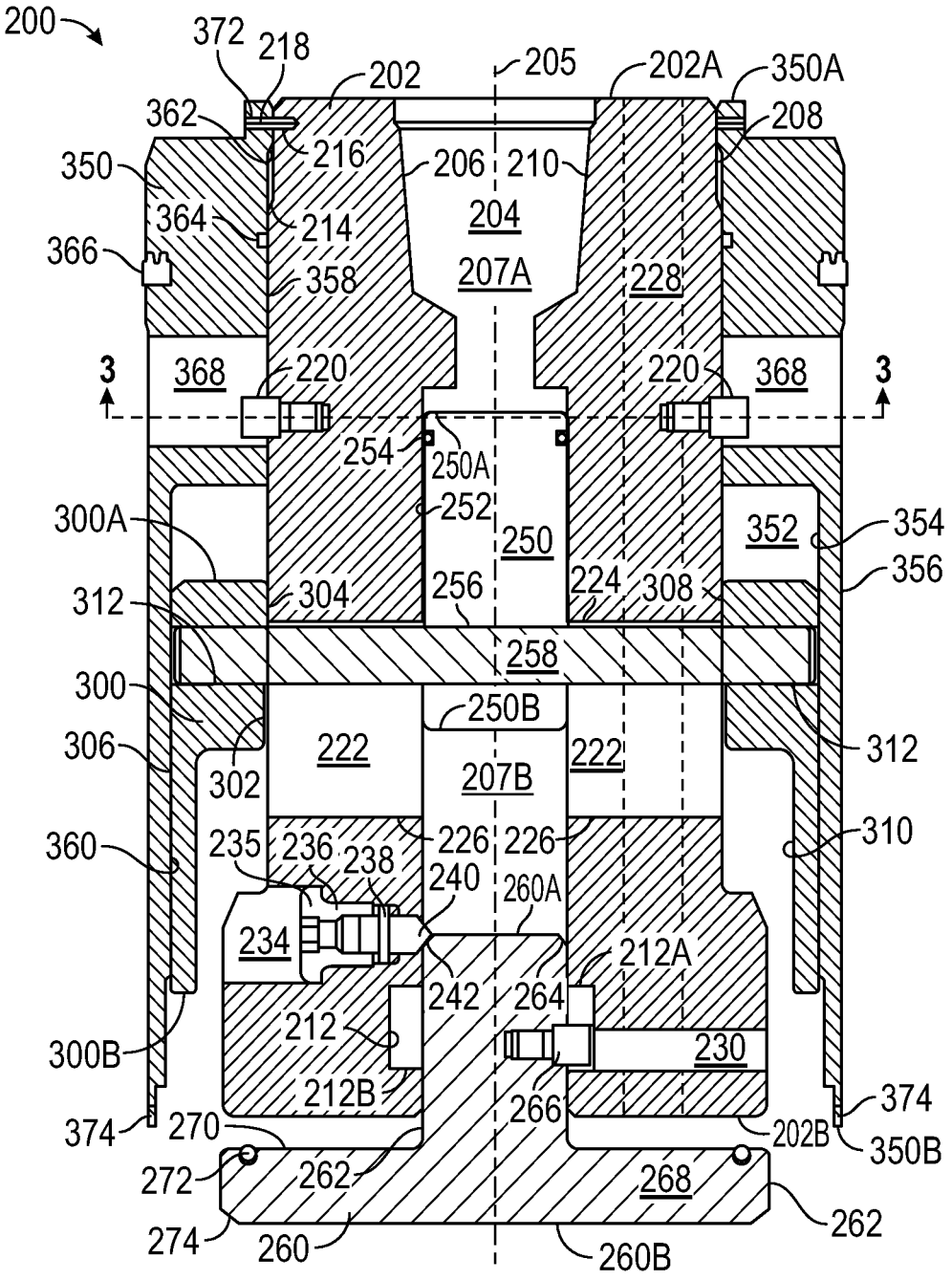
FIG. 2 is a cross-sectional view of an embodiment of a running tool assembly of the well system of FIG. 1 in accordance with principles disclosed herein.
Figure 3:
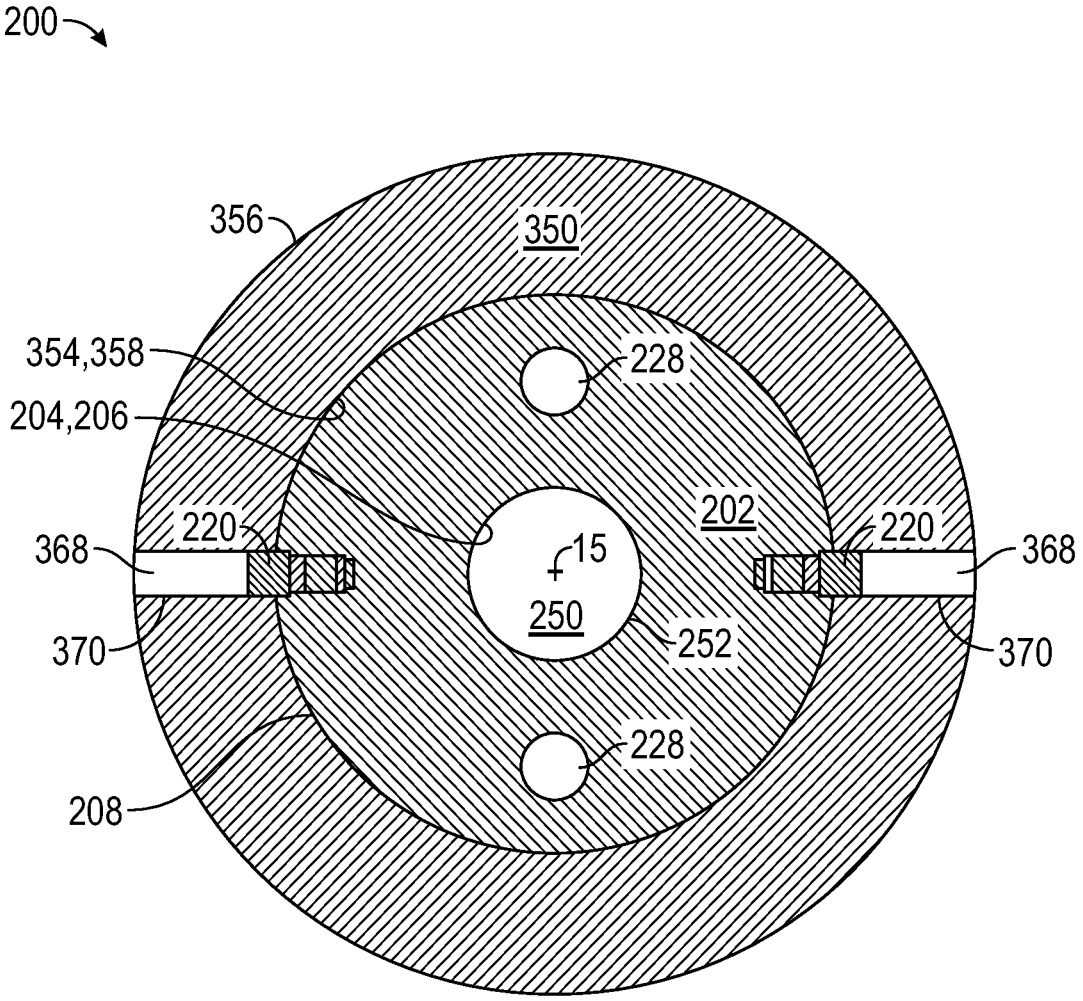
FIG. 3 is a cross-sectional view along lines 3-3 of FIG. 2 of the running tool assembly of FIG. 2.
Figure 4:
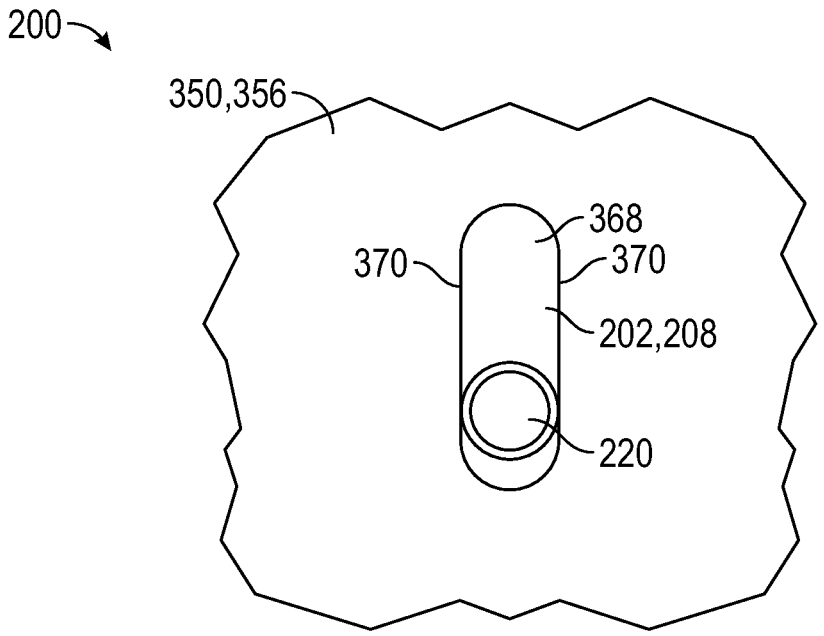
FIG. 4 is a zoomed-in front view of an embodiment of an anti-rotation member of the running tool assembly of FIG. 2 in accordance with principles disclosed herein.
Figure 5:
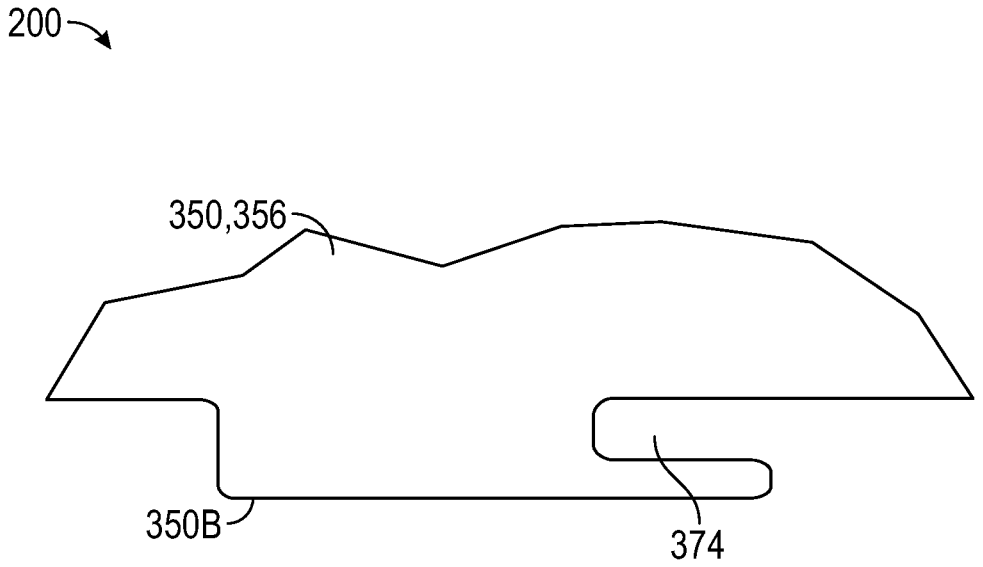
FIG. 5 is a zoomed-in front view of an embodiment of a j-slot of the running tool assembly of FIG. 2 in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well system 10 having a central or longitudinal axis 15. The well system 10 can be configured to extract various minerals and natural resources, including hydrocarbons (e.g., oil and/or natural gas), or configured to inject substances into an earthen surface 4 and an earthen formation 6 via a well or wellbore 8. In some embodiments, the well system 10 is land-based, such that the surface 4 is land surface, or subsea, such that the surface 4 is the seal floor. The system 10 includes a wellhead system 100 including a housing or wellhead 102 and a running tool assembly 200 conveyed by a tubular member or conveyance string 20. The wellhead 102 of wellhead system 100 is coupled to a wellbore 8 via a wellhead connector or hub 30. Wellhead 102 typically includes multiple components that control and regulate activities and conditions associated with the wellbore 8. For example, wellhead 102 generally includes bodies, valves and seals that route produced fluids from the wellbore 8, provide for regulating pressure in the wellbore 8, and provide for the injection of substances or chemicals downhole into the wellbore 8. Although in the embodiment shown in FIG. 1 wellhead system 100 forms a part of well system 10, in other embodiments, wellhead system 100 may be used in other well systems.

In the embodiment shown in FIG. 1, well system 10 additionally includes a blowout preventer (BOP) stack 40 coupled to wellhead 102. BOP stack 40 may include a variety of valves, fittings, and controls to prevent oil, gas, or other fluid from exiting the wellbore 8 in the event of an unintentional release of pressure or an overpressure condition. In the embodiment shown in FIG. 1, BOP stack 40 includes a central bore or passage 42 and an annular BOP 44 configured to, upon actuation, sealingly engage a tubular member (e.g. conveyance string 20, etc.) disposed therein. Additionally, in this embodiment, wellhead system 100 includes a wellhead component 150 disposed within the wellhead 102 of wellhead system 100. In this embodiment, wellhead component 150 comprises a tubing and/or casing hanger 150. For ease of description below, reference to "tubing" shall include casing and other tubulars associated with wellheads. Further, "housing" may also be referred to as "spool," "receptacle," or "bowl." In some embodiments, wellhead system 100 may include additional components not shown in FIG. 1, including a Christmas or production tree and/or additional devices.

Hanger 150 of wellhead system 100 may be installed within wellhead 102 using a running tool suspended from a conveyance tool or string. Additionally, as will be discussed further herein, assemblies associated with hanger 150, such as seal assemblies, may also be installed within wellhead 102 using a running tool suspended from a conveyance tool or string. For example, in the illustrated embodiment, running tool assembly 200, suspended from conveyance string 20, is configured to install a seal assembly of hanger 150 to seal the interface between hanger 150 and wellhead 102. In this embodiment, conveyance string 20 comprises a drill string lowered from an offshore vessel (not shown in FIG. 1). In other embodiments, such as land surface systems, running tool assembly 200 may comprise a device suspended over and/or lowered into the wellhead 102 via a crane or other supporting device.

In the embodiment shown in FIG. 1, wellhead 102 of wellhead system 100 provides a base for BOP stack 40. In this embodiment, hanger 150 includes a central bore or passage 152 that fluidly couples with and enables fluid communication between the bore 42 of BOP stack 40 and wellbore 8. Thus, bores 42 and 152 provide access to the wellbore 8 for various completion and workover procedures. For example, components can be run down to the wellhead 102 and disposed therein to seal off the wellbore 8, to inject fluids downhole, to suspend tools downhole, to retrieve tools downhole, and the like. For instance, additional casing and/or tubing hangers may be installed within wellhead 102. As one of ordinary skill in the art understands, the wellbore 8 may contain elevated pressures. For example, the wellbore 8 may include pressures that exceed 10,000 pounds per square inch (PSI). Accordingly, well system 10 employs various mechanisms, such as mandrels, seals, plugs and valves, to control and regulate the wellbore 8. For example, the hanger 150 may be disposed within the wellhead 102 to secure tubing and casing suspended in the wellbore 8, and to provide a path for hydraulic control fluid, chemical injections, and the like.

Referring to FIGS. 1-5, an embodiment of running tool assembly 200 of the well system of FIG. 1 is shown in FIGS. 2-5. In the embodiment shown in FIGS. 2-5, running tool assembly 200 has a central or longitudinal axis 205 and generally includes a mandrel or tool body 202, an inner piston 250, a landing plate 260, an inner sleeve 300, and an outer piston or sleeve 350. In some embodiments, outer piston 350 may comprise a first piston 350 while inner piston 250 comprises a second piston 250. Tool body 202 is generally configured to couple with conveyance string 20 and provide fluid communication for the actuation of components of running tool assembly 200, as will be discussed further herein. In the embodiment shown in FIGS. 2-5, tool body 202 is generally cylindrical and includes a first or upper terminal end 202A, a second or lower terminal end 202B, a central bore or passage 204 extending between ends 202A and 202B defined by a generally cylindrical inner surface 206, and a generally cylindrical outer surface 208 also extending between ends 202A and 202B. Inner surface 206 of bore 204 includes a connector 210 proximal upper end 202A configured for coupling with a conveyance tool, such as conveyance string 20. In the embodiment shown in FIGS. 2-5, connector 210 comprises a releasable or threaded connector 210; however, in other embodiments, connector 210 may comprise other connectors or couplers known in the art. The inner surface 206 of tool body 202 also includes an annular groove 212 extending radially therein and disposed proximal lower end 202B. Annular groove 212 includes a first or upper end 212A and a second or lower end 212B axially spaced from upper end 212A.

In the embodiment shown in FIGS. 2-5, the outer surface 208 of tool body 202 includes an annular shoulder 214 proximal to, but axially spaced from upper end 202A. As will be discussed further herein, shoulder 214 of outer surface 208 is configured to delimit axial movement of outer piston 350 relative to tool body 202. Outer Surface 208 of tool body 202 also includes at least one upper receptacle 216 extending therein and disposed at upper end 202A for receiving a shear pin or member 218 that provides a frangible connection between tool body 202 and outer piston 350. In some embodiments, tool body 202 includes a plurality of circumferentially spaced upper receptacles 216 each receiving a corresponding shear pin 218. In this embodiment, the outer surface 208 of tool body 202 further includes a plurality of circumferentially spaced anti-rotation members or keys 220 (shown particularly in FIGS. 2-4) that extend or project radially outwards from outer surface 208. In the embodiment shown in FIGS. 2-5, tool body 202 includes two anti-rotation keys 220 circumferentially spaced approximately 180° apart on outer surface 208; however, in other embodiments, tool body 202 may include varying numbers of anti-rotation keys 220 having varying circumferential spacing therebetween. As will be discussed further herein, anti-rotation keys 220 are configured to restrict relative rotation between tool body 202 and outer piston 350 and to, thereby, permit the transmission of torque between tool body 202 and outer piston 350.

In the embodiment shown in FIGS. 2-5, tool body 202 includes a pair of circumferentially spaced elongate slots 222 extending axially therein. Each elongate slot 222 extends axially within tool body 202 between a first or upper end 224 and a second or lower end 226. Additionally, each slot 202 extends radially within tool body 202 between inner surface 206 and outer surface 208. In this embodiment, elongate slots 222 are located axially between anti-rotation keys 220 and annular groove 212. Additionally, in this embodiment, elongate slots 222 of tool body 202 are circumferentially spaced approximately 180° apart; however, in other embodiments, tool body 202 may include varying numbers of elongate slots 222, including a single elongate slot 222. Tool body 202 also includes a plurality of circumferentially spaced flowby passages or bores 228 (shown in outline in FIG. 2) radially offset from central axis 205 and central bore 204. As will be discussed further herein, flowby passages 228 are configured to provide fluid communication between the upper and lower ends 202A and 202B, respectively, of tool body 202. In the embodiment shown in FIGS. 2-5, tool body 202 includes two flowby passages 228 circumferentially spaced approximately 180° apart (shown in FIG. 3); however, in other embodiments, tool body 202 may include varying numbers of flowby passages 228 circumferentially spaced at varying angles relative to each other. In still other embodiments, tool body 202 may not include any flowby passages 228.

In the embodiment shown in FIGS. 2-5, tool body 202 includes an aperture 230 located proximal lower end 202B and extending radially between outer surface 208 and the annular groove 212 of inner surface 206, where aperture 230 is configured to facilitate the coupling of tool body 202 with landing plate 260. However, in other embodiments, tool body 202 may not include aperture 230. Additionally, tool body 202 includes at least one lower receptacle 234 disposed proximal to, but axially spaced from lower end 202B. Lower receptacle 234 extends radially between inner surface 206 and outer surface 208 and receives a shear assembly 235 therein. As shown particularly in FIG. 2, shear assembly 235 includes a housing 236 coupled or secured to receptacle 234, and a shear pin or member 238 coupled to housing 236 via a cartridge or shearing member 240. Cartridge 240 is slidably disposed in housing 236 and is secured or restrained in a radially inner position in housing 236 by shear pin 238. In the radially inner position, engagement from a cammed or profiled inner end 242 of cartridge 240 restricts relative axial movement between landing plate 260 and tool body 202 in the upwards direction (i.e., the direction towards upper end 202A of tool body 202). As will be discussed further herein, in response to the application of an axially directed force against the profiled inner end 242 of cartridge 240, cartridge 240 is configured to translate the axially directed force into a radially outwards directed force to shear the shear pin 238 and thereby allow cartridge 240 to actuate or displace into a radially outer position. When in the radially outer position, cartridge 240 permits landing plate 260 to displace or travel upwards relative tool body 202. In some embodiments, tool body 202 includes a plurality of circumferentially spaced lower receptacles 234 each receiving a corresponding shear assembly 235

The inner piston 250 of running tool assembly 200 is slidably disposed in the central bore 206 of tool body 202. In the embodiment shown in FIGS. 2-5, inner piston 250 is generally cylindrical and has a first or upper end 250A, a second or lower end 250B, and a generally cylindrical outer surface 252 extending between ends 250A and 250B. The outer surface 252 of inner piston 250 includes an annular seal 254 disposed therein that is located proximal upper end 250A of inner piston 250. Annular seal 254 of inner piston 250 sealingly engages the inner surface 206 of the central bore 204 of tool body 202, thereby dividing central bore 206 into a first or upper passage 207A extending between upper end 202A of tool body 202A and seal 254, and a second or lower passage 207B extending between seal 254 and lower end 202B, where fluid communication between passages 207A and 207B is restricted by annular seal 254. In the embodiment shown in FIGS. 2-5, inner piston 250 additionally includes a radially extending slot 256 disposed proximal lower end 250B. Slot 256 radially extends entirely through inner piston 250 and receives a connector or elongate coupling pin 258 therein configured to couple inner piston 250 with inner sleeve 300. Coupling pin 258 extends radially through the pair of elongate slots 222 of tool body 202, allowing coupling pin 258 to couple with inner sleeve 300.

As mentioned above, inner piston 250 is slidably disposed in central bore 204 of tool body 202. Particularly, inner piston 250 is axially displaceable in central bore 204 between a first or upper position (shown in FIG. 2) and an axially spaced second or lower position (shown in FIG. 10) in response to the presence of a predetermined threshold pressure differential between the upper and lower passages 207A and 207B, respectively, of central bore 204. Coupling pin 258, received in slot 256, and inner sleeve 300, coupled with coupling pin 258, each are displaced axially in concert with inner piston 250 in response to the presence of the threshold pressure differential. In the upper position of inner piston 250, coupling pin 258 is disposed directly adjacent or physically engages the upper end 224 of each elongate slot 222, and is axially spaced from the lower end 226 of each slot 222. Conversely, when inner piston 250 is in the lower position, coupling pin 258 is disposed directly adjacent or physically engages the lower end 226 of each elongate slot 222, and is axially spaced from the upper end 224 of each slot 222. In some embodiments, ends 224 and 226 of elongate slots 222 delimit or define the extent of axial travel of inner piston 250, coupling pin 258, and inner sleeve 300 relative to tool body 202.

The landing plate 260 of running tool assembly 200 is slidably disposed in the lower passage 207B of the central bore 206 of tool body 202. In the embodiment shown in FIGS. 2-5, landing plate 260 has a first or upper end 260A, a second or lower end 260B, and a generally cylindrical outer surface 262 extending between ends 260A and 260B. The outer surface 262 of landing plate 260 includes a first or upper annular profile 264 or angled surface at upper end 260A configured to engage the profiled inner end 242 of cartridge 240. The outer surface 262 of landing plate 260 additionally includes at least one locating pin or key 266 extending radially outwards therefrom. In some embodiments, the outer surface 262 of landing plate 260 may include a plurality of circumferentially spaced locating keys 266. Locating key 266 extends radially into the annular groove 212 of tool body 202. In the embodiment shown in FIGS. 2-5, a diameter of the outer surface 262 of landing plate 260 disposed adjacent locating key 266 is similar to, although at least slightly less than, a diameter of the inner surface 206 of central bore 204 disposed adjacent to annular groove 212. Thus, with locating key 266 extending radially outwards from the outer surface 262 of landing plate 260, locating key 266 is trapped or captured within annular groove 212, thereby coupling landing plate 260 to tool body 202. In some embodiments, the aperture 230 of tool body 202 allows for the coupling or installation of locating key 266 within the outer surface 262 of landing plate 260.

In the embodiment shown in FIGS. 2-5, the lower end 260B of landing plate 260 comprises a radially outwards extending annular flange 268 that forms an annular shoulder 270 facing the lower end 202B of tool body 202. A diameter of the outer surface 262 of landing plate 260 at the flange 268 is greater than a diameter of the inner surface 206 of central bore 204 at the lower end 202B of tool body 202, restricting flange 268 from entering central bore 204. The annular shoulder 270 of flange 268 includes a face seal 272 disposed therein and located proximal to the outer surface 262 of flange 268. Additionally, in the embodiment shown in FIGS. 2-5, the lower end 260B of landing plate 260 includes a second or lower annular profile or angled surface 274. Particularly, lower annular profile 274 extends radially between the outer surface 262 of flange 268 and the lower end 260B of landing plate 260.

Figure 7:
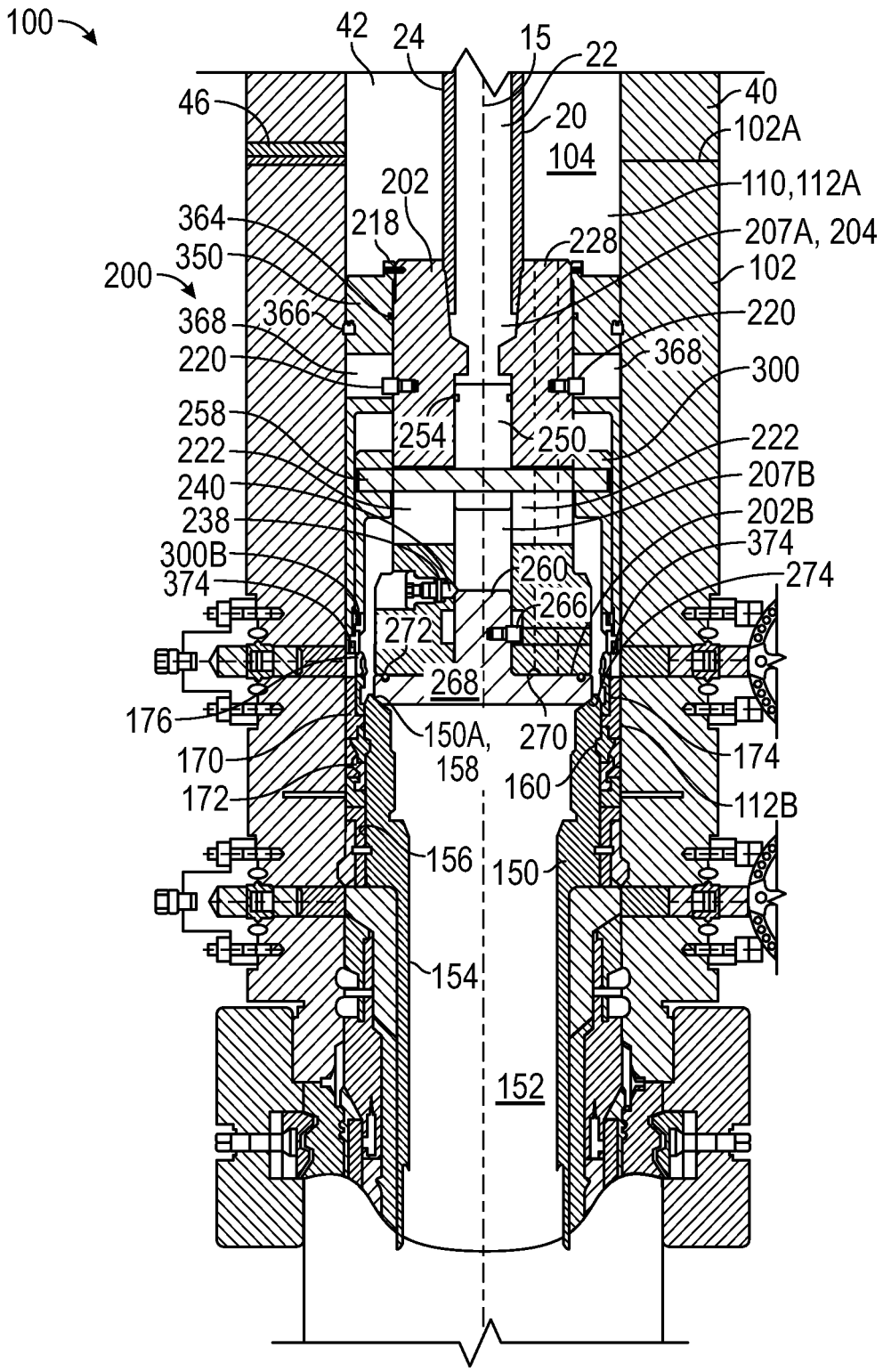
FIG. 7 is a cross-sectional view of the running tool assembly of FIG. 2 shown in a second position in the wellhead assembly of the well system of FIG. 1.

As mentioned above, landing plate 260 is slidably received in the central bore 204 of tool body 202. Particularly, landing plate 260 is axially displaceable in central bore 204 between a first or lower position (shown in FIG. 2) and a second or upper position (shown in FIG. 7) axially spaced from the lower position. In the lower position of landing plate 260, locating key 266 is disposed proximal or directly adjacent the lower end 212B of annular groove 212 and the annular shoulder 270 of flange 268 is axially spaced from the lower end 202B of tool body 202. Additionally, the upper annular profile 264 of landing plate 260 is disposed directly adjacent or physically engages the profiled inner end 242 of cartridge 240. In the upper position, locating key 266 is disposed proximal or directly adjacent the upper end 212A of annular groove 212 and face seal 272 is in sealing engagement with the lower end 202B of tool body 202, thereby restricting fluid communication between the lower end of each flowby passage 228 and the environment surrounding the lower end 202B of tool body 202. Additionally, when landing plate 260 is in the upper position, the upper end 260A of plate 260 is disposed axially above cartridge 240 with cartridge 240 disposed in the radially outer position to allow landing plate 260 to be displaced into the upper position. When cartridge 240 is in the radially inner position shown in FIG. 2, cartridge 240 is configured to retain landing plate 260 in the lower position via engagement from profiled inner end 242. As discussed above, cartridge 240 is configured to shear the shear pin 238 and actuate from the radially inner position to the radially outer position in response to the application of a predetermined threshold axially upwards force against cartridge 240. This axially directed threshold force may be applied to landing plate 260, which transmits the threshold force to cartridge 240 via physical engagement or contact with the profiled inner end 242 of cartridge 240.

The inner sleeve 300 of running tool assembly 200 is slidably disposed about the outer surface 208 of tool body 202. As will be discussed further herein, inner sleeve 300 is generally configured to selectively actuate an annular locking member or lock ring of an annular seal assembly to lock or secure the seal assembly into position within a wellhead of a well system, such as wellhead 102 of well system 10. Particularly, inner sleeve 300 is configured to actuate the lock ring in response to the communication of fluid pressure to the upper passage 207A of the central bore 204 of tool body 202. In the embodiment shown in FIGS. 2-5, inner sleeve 300 is generally cylindrical and has a first or upper terminal end 300A, a second or lower terminal end 300B, a central bore or passage 302 extending between ends 300A and 300B defined by a generally cylindrical inner surface 304, and a generally cylindrical outer surface 306 extending between ends 300A and 300B.

In the embodiment shown in FIGS. 2-5, the inner surface 304 of inner sleeve 300 includes a reduced diameter section 308 extending axially from upper end 300A and an extended diameter section 310 extending axially from lower end 300B. Reduced diameter section 308 is disposed directly adjacent or physically engages the outer surface 208 of tool body 202 while extended diameter section 310 is radially spaced from outer surface 208. Inner sleeve 300 additionally includes a pair of circumferentially spaced slots 312 disposed proximal upper end 300A, where each slot 312 is configured to receive an opposing end of coupling pin 258, thereby coupling inner sleeve 300 with both coupling pin 258 and inner piston 250 and restricting relative axial movement between inner sleeve 300 and both coupling pin 258 and inner piston 250. As discussed above, inner sleeve 300 is axially displaceable relative to tool body 202 in concert with inner piston 250 and coupling pin 258. As will be discussed further herein, the lower end 300B of inner sleeve 300 is configured to actuate the lock ring in response to displacement of inner piston 250 from the upper position to the lower position.

The outer piston 350 of running tool assembly 200 is slidably disposed about both the outer surface 208 of tool body 202 and the outer surface 306 of inner sleeve 300. In other words, outer piston 350 is configured to be displaced axially relative to both tool body 202 and inner sleeve 300. As will be discussed further herein, outer piston 350 is generally configured to selectively actuate or energize an annular seal assembly to seal the interface between a hanger (e.g., a tubing or casing hanger) and a housing of a wellhead, such as the interface between hanger 150 and wellhead 102 of well system 10. Particularly, outer piston 350 is configured to actuate the seal assembly in response to the communication of fluid pressure to an annulus disposed above an upper end of running tool assembly 200. In the embodiment shown in FIGS. 2-5, outer piston 350 is generally cylindrical and has a first or upper terminal end 350A, a second or lower terminal end 350B, a central bore or passage 352 extending between ends 350A and 350B defined by a generally cylindrical inner surface 354, and a generally cylindrical outer surface 356 extending between ends 350A and 350B.

In the embodiment shown in FIGS. 2-5, the inner surface 354 of outer piston 350 includes a reduced diameter section 358 extending axially from upper end 350A and an extended diameter section 360 extending axially from lower end 350B. Reduced diameter section 358 is disposed directly adjacent or physically engages the outer surface 208 of tool body 202 while extended diameter section 360 is radially spaced from outer surface 208 and directly adjacent or physically engages the outer surface 306 of inner sleeve 300. The reduced diameter section 358 of inner surface 354 includes an annular shoulder 362 located proximal to upper end 350A and an annular seal 364 axially spaced from shoulder 362. In some embodiments, annular shoulder 362 is configured to delimit or define the extent of relative axial movement between outer sleeve 350 and tool body 202 via interference or engagement with the annular shoulder 214 of tool body 202. Annular seal 364 of inner surface 354 is configured to sealingly engage the outer surface 208 of tool body 202. The outer surface 356 of outer piston 350 includes an annular seal 366 located proximal to, but axially spaced from upper end 350A. In this embodiment, seal 366 of outer surface 356 is located axially proximal to the seal 364 of inner surface 354, and is configured to sealingly engage the inner surface of a wellhead, such as wellhead 102 of well system 10.

In the embodiment shown in FIGS. 2-5, outer piston 350 includes a pair of circumferentially spaced elongate slots 368 (shown particularly in FIGS. 2-4), where each elongate slot 368 extends radially between outer surface 356 and the reduced diameter section 358 of inner surface 354. Each elongate slot 368 receives a corresponding anti-rotation key 220 of tool body 202. Elongate slots 368 are configured to permit limited axial travel of the anti-rotation key 220 received therein while restricting relative rotation between the slot 368 and its corresponding anti-rotation key 220. In this manner, torque applied to tool body 202 causes each anti-rotation key 220 to engage an axially extending surface or edge 370 (shown in FIGS. 3 and 4) of each elongate slot 368 and transfer torque (and possibly rotation) to outer piston 350 via the physical engagement between corresponding pairs of anti-rotation keys 220 and elongate slots 368. In this embodiment, elongate slots 368 are circumferentially spaced approximately 180° apart; however, in other embodiments, outer piston 350 may include varying numbers of elongate slots 368 spaced circumferentially at varying degrees.

In the embodiment shown in FIGS. 2-5, outer piston 350 includes at least one receptacle 372 extending therein and located at upper end 350A for receiving a corresponding shear pin 218. As mentioned above, shear pin 218 provides a frangible connection between tool body 202 and outer piston 350. Particularly, shear pin 218 restricts relative axial movement between outer piston 350 and tool body 202. However, shear pin 218 is configured to shear upon the application of a predetermined threshold force directed axially downwards against outer piston 350, thereby allowing for relative axial movement between outer piston 350 and tool body 202. In the embodiment shown in FIGS. 2-5, outer piston 350 additionally includes a plurality of circumferentially spaced releasable connectors or j-slots 374 (shown in FIGS. 2 and 5) located at lower end 350B. J-slots 374 each comprise an arcuately extending slot 374 and, as will be discussed further herein, are configured to releasably couple to an annular seal assembly for installation in a wellhead system, such as wellhead system 100. Particularly, j-slots 374 are configured to selectively decouple from the seal assembly in response to relative rotation between the outer piston 350 and the seal assembly, as will be discussed further herein.

Referring to FIGS. 1 and 6-10, an embodiment of wellhead 102 and hanger 150 of the wellhead system 100 of FIG. 1 are shown in greater detail in FIGS. 6-10. In the embodiment shown in FIGS. 6-10, wellhead 102 comprises a wellhead housing 102 having a central bore or passage 104 defined by a generally cylindrical inner surface 106. BOP stack 40 is shown schematically in FIGS. 6-10 as coupled to an upper end 102A of wellhead housing 102; however, in other embodiments, other components of wellhead system 100 may be interposed between wellhead housing 102 and BOP stack 40, such as other housings, spools, risers, or other equipment. In the embodiment shown in FIGS. 6-10, BOP stack 40 includes a port 46 configured to provide selective fluid communication to central bore 42 of BOP stack 40. In some embodiments, port 46 is coupled with a choke or kill line extending to BOP stack 40.

Disposed within central bore 104 of wellhead housing 102 is hanger 150, which, as described above, is configured to suspend tubing or casing strings coupled therewith into the wellbore 8 for physically supporting wellbore 8 and/or routing fluid flow between wellhead system 100 and wellbore 8. In the embodiment shown in FIGS. 6-10, hanger 150 includes central bore 152 extending from a first or upper end 150A of hanger 150 and defined by a generally cylindrical inner surface 154, and a generally cylindrical outer surface 154 extending from upper end 150A. Upper end 150A of hanger 150 comprises an annular angled profile 158. In some embodiments, angled profile 158 of hanger 150 may comprise a landing profile for other hangers or equipment landed within the central bore 104 of wellhead housing 102. The outer surface 156 includes an annular locking groove 160 extending therein and located proximal upper end 150A. In the embodiment shown in FIGS. 6-10, locking groove 160 comprises a double groove 160 including a pair of axially spaced grooves in the outer surface 156 of wellhead housing 102.

In the embodiment shown in FIGS. 6-10, wellhead system 100 includes an axially settable component or seal assembly 170, including a plurality of annular seals 172, disposed radially between the outer surface 156 of hanger 150 and the inner surface 106 of wellhead housing 102. As used herein, the term "axially settable component" refers to a component that is set, locked, actuated, and/or energized in response to the application of an axially directed force from a setting or running tool. The term "axially directed force" refers to a force in a direction parallel with a longitudinal or central axis of the setting or running tool (e.g., central axis 205 of running tool assembly 200). As will be discussed further herein, annular seals 172 are configured to sealingly engage both the outer surface 156 of hanger 150 and the inner surface 104 of wellhead housing 102 in response to being actuated or energized by running tool assembly 200. In the embodiment shown in FIGS. 6-10, wellhead system 100 additionally includes an axially settable component or lock ring 174 carried by the seal assembly 170 and configured to lock the seal assembly 170, including annular seals 172, into position in response to actuation by running tool assembly 200. Particularly, lock ring 174 includes a first or radially outer position (shown in FIGS. 6-9) disengaged from locking groove 160 of hanger 150 and a second or radially inner position (shown in FIG. 10) received at least partially in locking groove 160. In the radially inner position, lock ring 174 is restricted from moving axially relative hanger 150, thereby locking seal assembly 170 into position with annular seals 172 sealing against outer surface 156 of hanger 150 and the inner surface 104 of wellhead housing 102. In the embodiment shown in FIGS. 6-10, seal assembly 170 includes an actuation or energization ring 176 configured to actuate or displace lock ring 174 from the radially outer position to the radially inner position in response to the application of a sufficient or threshold axially directed force against actuation ring 176 from running tool assembly 200. Actuation ring 176 is configured to couple to running tool assembly 200 via the j-slots 374 of outer piston 350.

As described above, wellhead system 100 also includes conveyance string 20. As shown in FIGS. 6-10, conveyance string 20 includes a central bore or passage 22 and a generally cylindrical outer 24 that includes a connector 26 at terminal end of string 20. In the embodiment shown in FIGS. 6-10, connector 26 comprises a releasable or threaded connector 26; however, in other embodiments, connector 26 may comprise other connectors or couplers known in the art. In this embodiment, connector 26 of conveyance string 20 is configured to releasably or threadably connect with connector 210 of the tool body 202 of running tool assembly 200 to couple assembly 200 with conveyance string 20. In this embodiment, the connection formed between connector 26 of conveyance string 20 and connector 210 of tool body 202 comprises a sealed or premium threaded connection configured to restrict fluid communication between the upper passage 207A of tool body 202 and an annulus 110 formed between the outer surface 24 of string 20 and the inner surface 106 of wellhead housing 102. Particularly, annulus 110 includes a first axially extending portion disposed radially between string 20 and wellhead housing 102 and a second axially extending portion disposed radially between the outer surface 356 of the outer piston 350 of running tool assembly 200 and the inner surface 106 of wellhead housing 104.

Figure 6:
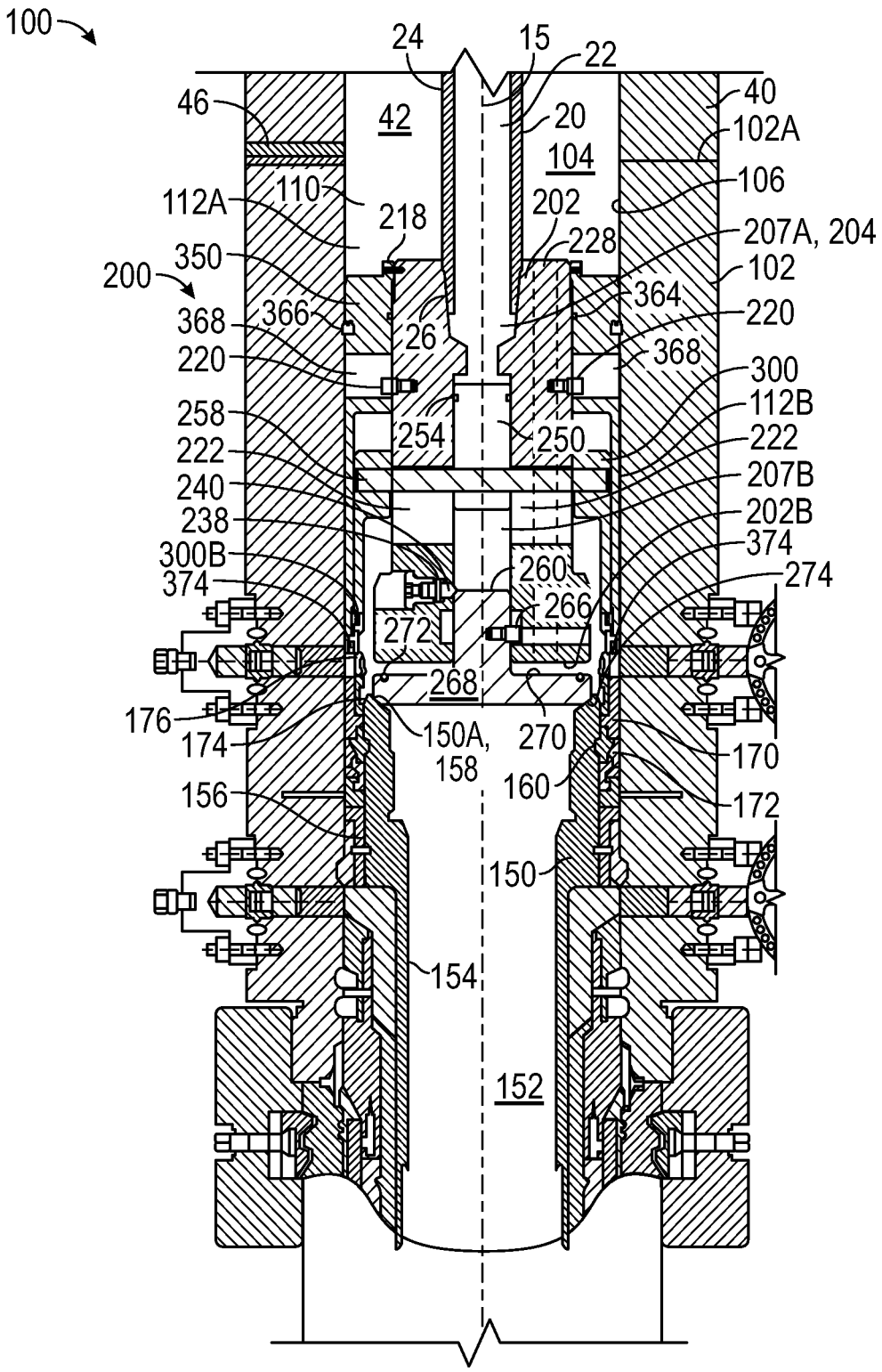
FIG. 6 is a cross-sectional view of the running tool assembly of FIG. 2 shown in a first position in an embodiment of a wellhead assembly of the well system of FIG. 1 in accordance with principles disclosed herein.

Referring to FIGS. 2 and 6-10, conveyance string 20 and running tool assembly 200 are configured to seal assembly 170 and lock ring 174 in wellhead housing 102 as part of a completion operation to prepare well system 10 for the production of hydrocarbons from the subterranean formation 6. Prior to the utilization of running tool assembly 200, hanger 150 may be landed within the central bore 104 of wellhead housing 102 (as shown in FIG. 6) using another running tool or via other methods known in the art. Following the landing of hanger 150 within wellhead housing 102, seal assembly 170 may be attached to running tool assembly 200 by coupling actuation ring 176 with j-slots 374 of outer piston 350 and running tool assembly 200 may be suspended from conveyance string 20 (via the connection formed between connector 26 of string 20 and connector 210 of tool body 202) and lowered through the central bore 42 of BOP stack 40 and into central bore 104 of wellhead housing 102.

With running tool assembly 200 positioned in central bore 104 of wellhead housing 102, annular seal 366 of outer piston 350 sealingly engages the inner surface 106 of wellhead housing 102. The sealing engagement of seal 366 against inner surface 106 in conjunction with the sealing engagement provided by annular seal 364 of outer piston 350 against the outer surface 208 of tool body 202 divides the annulus 110 formed in central bore 104 of wellhead housing 106 into a first or upper annulus 112A extending towards the upper end 102A of wellhead housing 102 from seal 366 and a second or lower annulus 112B extending downwards from seal 366. In this arrangement, fluid communication between upper and lower annuli 112A and 112B is facilitated by flowby passages 228 of tool body 202. Particularly, flowby passages 228 allow annular seal 366 to seal against wellhead housing 102 while permitting fluid disposed in central bore 104 to vent or escape through flowby passages 228 as running tool assembly 200 is lowered through central bore 104. In other words, if central bore 104 is filled with fluid as running tool assembly 200 is lowered into bore 104 of wellhead housing 102, fluid disposed in central bore 104 may be vented through flowby passages 228 to prevent hydraulic lock from forming in central bore 104, which would prohibit the continual lowering of running tool assembly 200 through central bore 104. Thus, flowby passages 228 eliminate the need to drain central bore 104 of fluid prior to lowering running tool assembly 200 into central bore 104 of wellhead housing 102.

Conveyance string 20 and running tool assembly 200 are continually lowered through central bore 104 of wellhead housing 102 until the lower annular profile 274 of landing plate 260 matingly engages or lands against the angled profile 158 of hanger 150, as shown particularly in FIG. 6. Once landing plate 260 of running tool assembly 200 is landed against hanger 150 the weight of conveyance string 20 applies an axially downwards directed force against tool body 202 sufficient to actuate cartridge 240 of shear assembly 235 from the radially inner position to the radially outer position thereby shearing the shear pin 238. The actuation of cartridge 240 into the radially outer position permits or allows tool body 202 to continue travelling downwards (i.e., in the axial direction away from upper end 102A of wellhead housing 102) through central bore 104 of wellhead housing 102 until the lower end 202B of tool body 202 engages the annular shoulder 270 of the flange 268 of landing plate 260, as shown particularly in FIG. 7. In this manner, the landing plate 260 is displaced from the lower position shown in FIG. 7 to the upper position shown in FIG. 7. In the position shown in FIG. 7, face seal 272 of landing plate 260 seals against the lower end 202B of tool body 202, thereby sealing off flowby passages 228 and restricting fluid communication between upper annulus 112A and lower annulus 112B.

Figure 8:
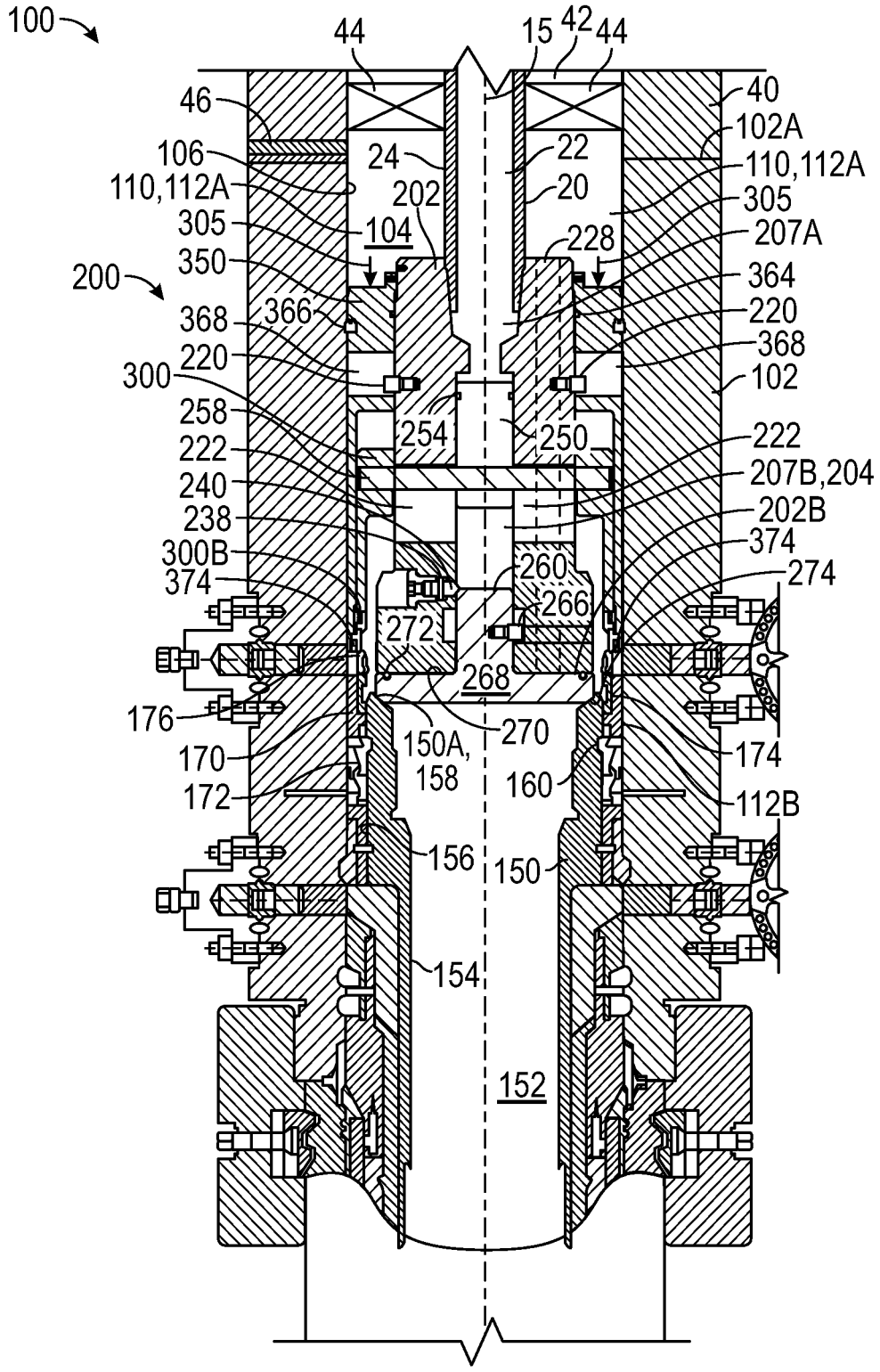
FIG. 8 is a cross-sectional view of the running tool assembly of FIG. 2 shown in a third position in the wellhead assembly of the well system of FIG. 1.

With landing plate 260 displaced into the upper position, thereby restricting fluid communication between upper annulus 112A and lower annulus 112B, the annular BOP 44 of BOP stack 40 is actuated into a closed position to seal against the outer surface 24 of conveyance string 20, as shown particularly in FIG. 8. In this arrangement, upper annulus 112A comprises an annular chamber sealed at an upper end thereof by annular BOP 44 and at a lower end thereof by seals 366 and 364 of outer piston 350. Following the actuation of annular BOP 44 fluid pressure in upper annulus 112A is increased via fluid communication from port 46 of BOP stack 40 until a sufficient or threshold pressure force (indicated by arrows 305 in FIGS. 8 and 9) is applied against the upper end 350A of outer piston 350 to shear the shear pin 218 and displace outer piston 350 axially downwards through central bore 104 of wellhead housing 102. As outer piston 350 travels through central bore 104 tool body 202 and inner sleeve 300 are held stationary (i.e., are not moving axially) within bore 104 of wellhead housing 102.

In some embodiments, once shear pin 218 is sheared, fluid pressure in upper annulus 112A is held relatively constant, while in other embodiments, fluid pressure in upper annulus 112A may be allowed to continue to increase. In the embodiment shown in FIGS. 6-10, the pressure force 305 acting against the upper end 350A of outer piston 350 is held following the shearing of shear pin 218, allowing the axially downwards directed force 305 to be transmitted to seal assembly 170 via j-slots 374 of outer piston 350. Following a period of time of the pressure force 305 being applied to seal assembly 170, the annular seals 172 of assembly 170 are actuated or energized, causing the seals 172 to seal against both the outer surface 156 of hanger 150 and the inner surface 106 of wellhead housing 102, as shown particularly in FIG. 9. In this manner, the force required to energize seals 172 (i.e., pressure force 305) may be reacted against annular BOP 44 of BOP stack 40, eliminating the need to run additional control lines to wellhead housing 102 to supply the pressure force required to energize seals 172. Utilizing annular BOP 44 as a reaction point for directing pressure force 305 against seals 172 (via outer piston 350) also eliminates the need to run additional tools or components into wellhead housing 102 to supply a reaction point, such as locking dogs or other mechanisms. In turn, the elimination of additional control lines or reaction points reduces the time required for installing seal assembly 170 and energizing seals 172 and reduces the complexity of performing said installation.

Following the energization of the annular seals 172 of seal assembly 170, running tool assembly 200 may be used to displace lock ring 174 from the radially outer unlocked position (shown in FIG. 9) into the radially inner locked position (shown in FIG. 10) to secure seal assembly 170 in position within wellhead housing 102. Particularly, following the energization of seals 172, fluid pressure is increased within upper passage 207A via fluid communication provided by the central bore 22 of conveyance string 20. Once fluid pressure in upper passage 207A reaches a threshold pressure, an axially downwards directed threshold force (indicated by arrow 307 in FIG. 10) is applied to a first or upper terminal end of inner piston 250 sufficient to displace piston 250 downwards through central bore 204 of tool body 202 (and through central bore 104 of wellhead housing 102), thereby displacing or shifting inner piston 250 from the upper position shown in FIG. 9 to the lower position shown in FIG. 10. Downwards movement of inner piston 250 is transferred to inner sleeve 300 via coupling pin 258. As inner sleeve 300 is displaced or shifted downwards through central bore 104 of wellhead housing 102, the lower end 300B of inner sleeve 300 engages and axially shifts or displaces actuation ring 176, which acts against lock ring 174 to thereby shift lock ring 174 from the radially outer unlocked position to the radially inner locked position received in locking groove 160 of hanger 150, as shown particularly in FIG. 10. With lock ring 174 disposed in the radially inner locked position, seal assembly 170, including seals 172, are locked into position within wellhead housing 102, finishing or completing the installation of seal assembly 170 within wellhead housing 102.

Following the installation of seal assembly 170 within wellhead housing 102, fluid pressure within upper annulus 112A and in the upper passage 207A of tool body 202 may be bled down or reduced. Additionally, annular BOP 44 may be actuated into the open position. In the embodiment shown in FIGS. 6-10, following bleed down and the opening of annular BOP 44, torque is applied to conveyance string 20 to rotate string 20. Rotation of string 20 is transmitted to tool body 202 via the connection therebetween, and the rotation is further transmitted from tool body 202 to outer piston 350 via engagement between anti-rotation keys 220 of tool body 202 and the edges 370 of the elongate slots 368 of outer piston 350. Rotation of outer piston 350 decouples seal assembly 170 from the j-slots 374 of outer piston 350, allowing conveyance string 20 and running tool assembly 200 to be retracted from wellhead 102.

Figure 9:
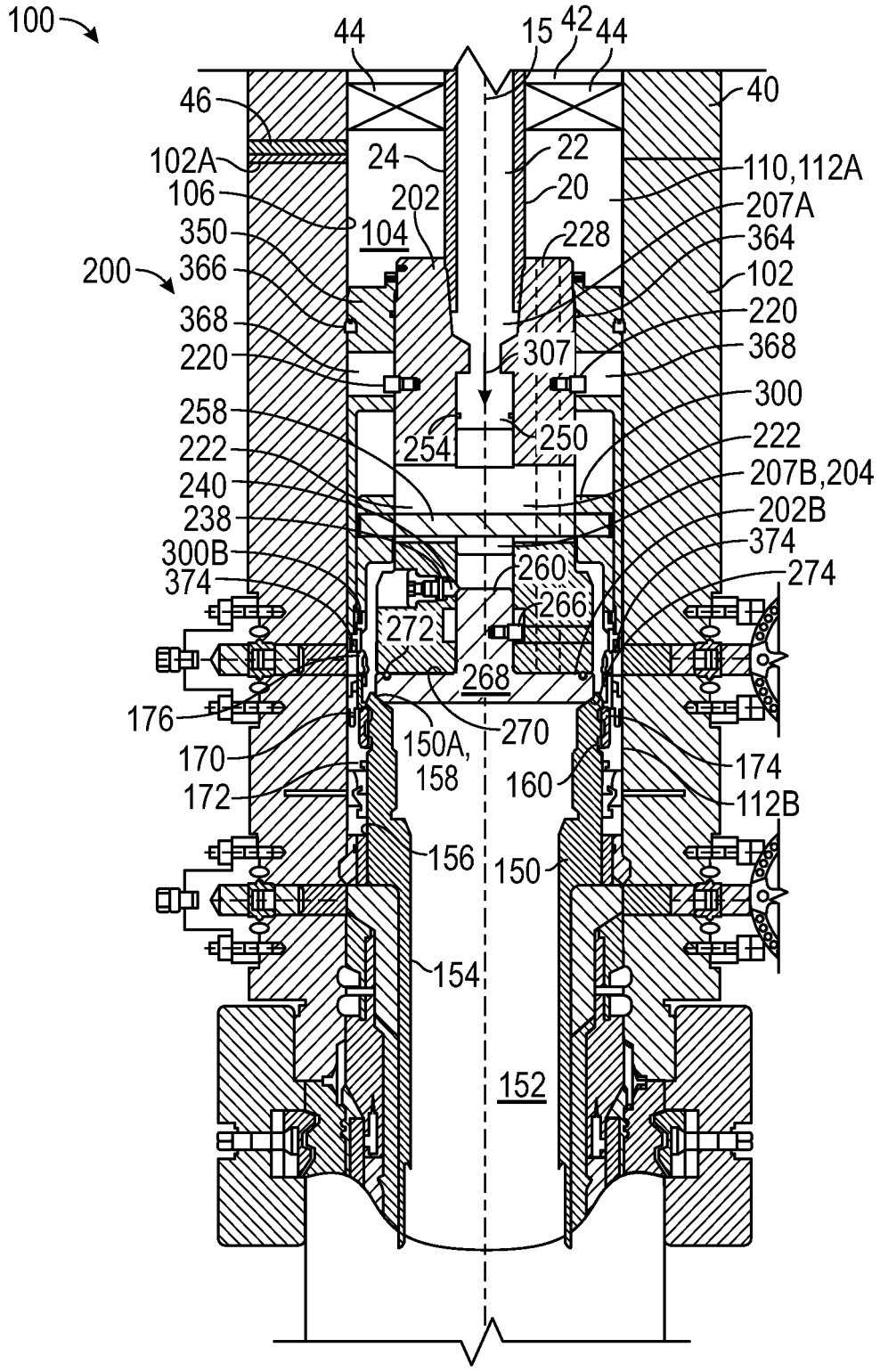
FIG. 9 is a cross-sectional view of the running tool assembly of FIG. 2 shown in a fourth position in the wellhead assembly of the well system of FIG. 1.
Figure 10:
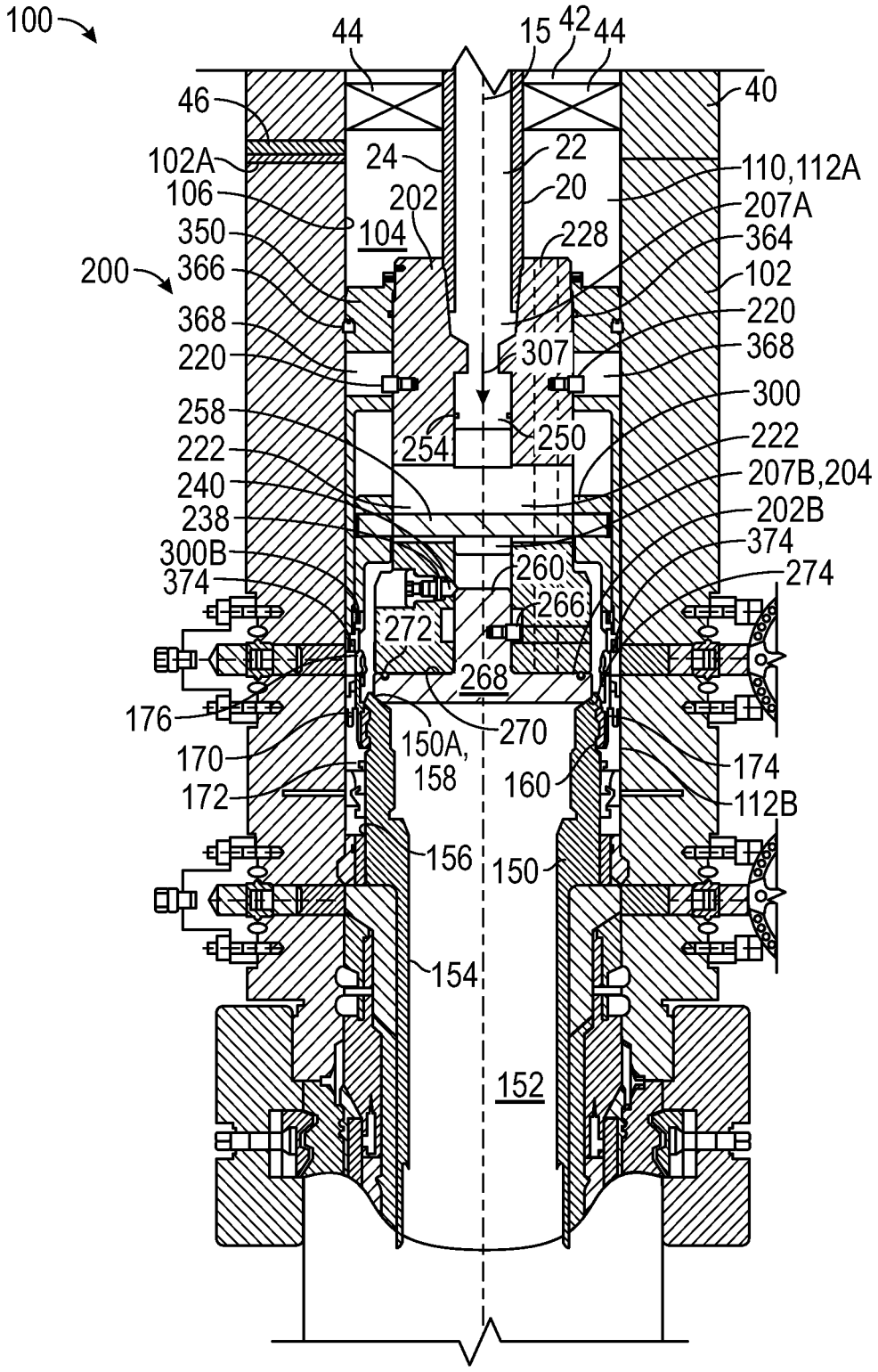
FIG. 10 is a cross-sectional view of the running tool assembly of FIG. 2 shown in a fifth position in the wellhead assembly of the well system of FIG. 1.

As running tool assembly 200 is raised upward through wellhead housing 102 via conveyance string 20, fluid disposed in upper annulus 112A is permitted to flow back into lower annulus 112B via flowby passages 228 as lifting plate 260 is lifted from the upper end 150A of hanger 150, permitting fluid pressure in flowby passages 228 to shift landing plate 260 back into the lower position (not shown in FIG. 10). In this manner, central bore 104 of wellhead housing 102 is permitted to refill with fluid following the extraction of running tool assembly 200 therefrom. Although in the embodiment shown in FIGS. 6-10 running tool assembly 200 is described in the context of installing seal assembly 170 and lock ring 174 via the actuation or displacement of actuation ring 176, in other embodiments, running tool assembly 200 may be used to install other equipment or components within tubular components of wellhead systems, such as components requiring axially directed setting or actuation forces.

Figure 11:
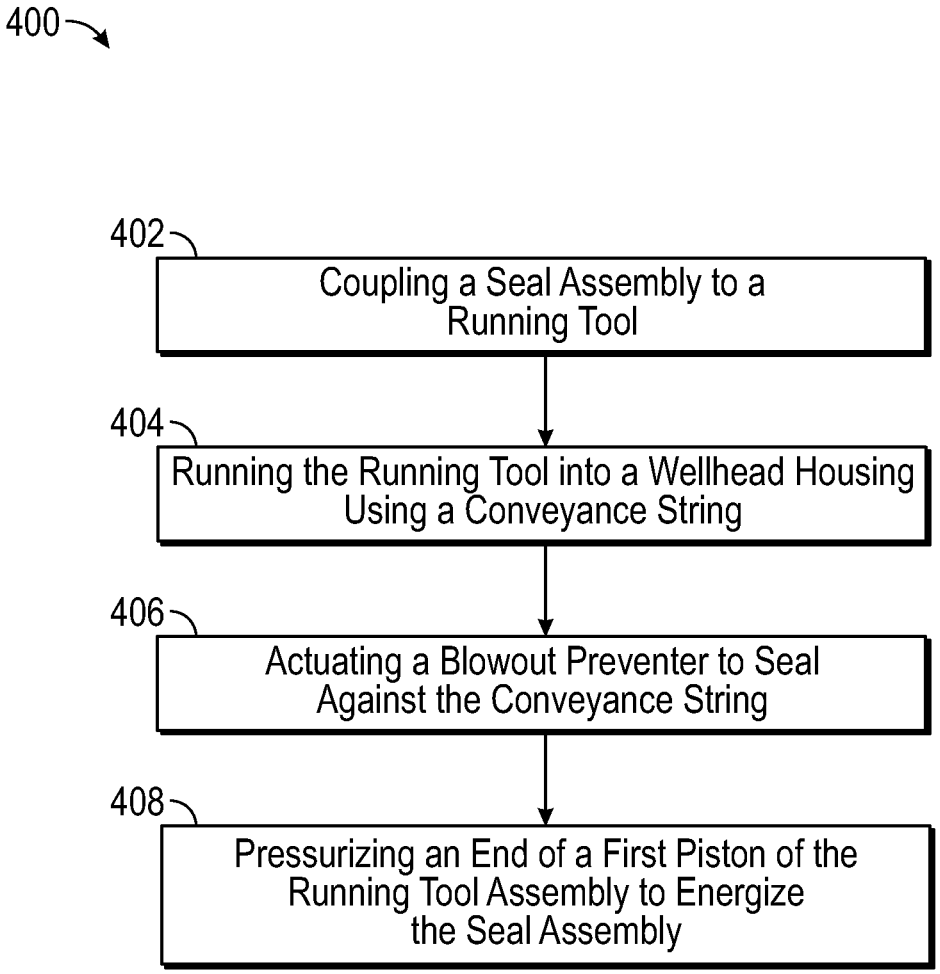
FIG. 11 is a flowchart illustrating an embodiment of a method for installing a seal assembly in a wellhead housing in accordance with principles disclosed herein.

Referring to FIGS. 1, 2, and 6-11, an embodiment of a method 400 for installing a seal assembly in a wellhead housing is shown in FIG. 11. At block 402 of method 400, a seal assembly is coupled to a running tool. In some embodiments, block 402 comprises coupling seal assembly 170 to the j-slots 374 of the outer piston 350 of running tool assembly 200. At block 404 of method 400, the running tool is run into a wellhead housing using a conveyance string. In some embodiments, block 404 comprises running tool assembly 200 into the central bore 104 of wellhead housing 102 using conveyance string 20, as shown in FIG. 6. At block 406 of method 400, a blowout preventer (BOP) is actuated to seal against the conveyance string. In certain embodiments, block 406 comprises actuating annular BOP 44 of BOP stack 40 to seal against the outer surface 24 of conveyance string 20, as shown in FIG. 8. At block 408 of method 400, an end of a first piston of the running tool is pressurized to energize the seal assembly. In certain embodiments, block 408 comprises pressurizing or applying a pressure force against the upper end 350A of outer piston 350 to shear the shear pin 218 and displace outer piston 350 axially through the central bore 104 of wellhead housing 102 and energize the annular seals 172 of seal assembly 170, as shown in FIGS. 8 and 9.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A running tool assembly for installing a seal assembly in a wellhead housing, comprising:

a mandrel configured to couple with a conveyance string;

a first piston slidably disposed about an exterior surface of the mandrel and configured to releasably couple with the seal assembly, wherein the first piston comprises an inner surface at an inner radius of the first piston, an outer surface at an outer radius of the first piston, and a first axial end extending radially from the inner surface to the outer surface; and an anti-rotation key extending from an outer surface of the mandrel, wherein the anti-rotation key is received in a slot of the first piston;

wherein, when the running tool is disposed in the wellhead housing and the first piston is coupled to the seal assembly, the first piston is configured to energize the seal assembly in response to a pressurization of the first axial end of the first piston.

2. The running tool assembly of claim 1, further comprising a shear pin coupling the first piston to the mandrel to restrict relative axial movement therebetween, wherein axial movement between the mandrel and the conveyance string is prevented at all times during deployment thereof, wherein the shear pin is configured to shear in response to the pressurization of the first axial end of the first piston.

3. The running tool assembly of claim 1, wherein the anti-rotation key is configured to restrict relative rotation while allowing limited relative axial movement between the mandrel and the first piston.

4. The running tool assembly of claim 1, wherein the first piston comprises a first seal sealing against an outer surface of the mandrel and a second seal configured to seal against an inner surface of the wellhead housing when the running tool is disposed in the wellhead housing.

5. The running tool assembly of claim 4, wherein the first and second seals of the first piston are configured to restrict fluid flow across the running tool assembly when the running tool assembly is disposed in the wellhead housing and the first axial end of the first piston is pressurized.

6. The running tool assembly of claim 1, further comprising:

a second piston slidably disposed in a central passage of the mandrel and comprising an annular seal that sealingly engages an inner surface of the central passage;

wherein, when the running tool assembly is disposed in the wellhead housing, the second piston is configured to set an axially settable component in response to a pressurization of the central passage of the mandrel, wherein the axially settable component is independent from the first piston.

7. The running tool assembly of claim 1, wherein the first piston is configured to energize the seal assembly prior to the running tool actuating a lock to secure the seal assembly.

8. A running tool assembly for installing a seal assembly in a wellhead housing, comprising:

a mandrel configured to couple with a conveyance string whereby axial movement between the mandrel and the conveyance string is prevented at all times during deployment thereof; and a first piston slidably disposed about the mandrel and configured to releasably couple with the seal assembly;

wherein the mandrel is defined by an outer surface extending from a first terminal end of the mandrel to a second a terminal end thereof, and wherein the outer surface of the mandrel is configured to receive a shear pin in at least one receptacle formed therein, the shear pin coupling the first piston to the mandrel to restrict relative axial movement therebetween;

wherein, when the running tool is being run to the wellhead housing prior to energizing the seal assembly and prior to actuating a lock to secure the seal assembly, the seal assembly has a first condition;

wherein, when the running tool is disposed in the wellhead housing and the first piston is coupled to the seal assembly, the first piston is configured to energize the seal assembly from the first condition to a second energized condition in response to a pressurization of an end of the first piston following shearing of the shear pin, wherein the seal assembly has the second energized condition prior to the running tool actuating the lock to secure the seal assembly.

9. The running tool assembly of claim 8, further comprising an anti-rotation key extending from the outer surface of the mandrel, wherein the anti-rotation key is received in a slot of the first piston, wherein the anti-rotation key is configured to restrict relative rotation while allowing limited relative axial movement between the mandrel and the first piston.

10. The running tool assembly of claim 8, further comprising a second piston independent form the first piston, wherein the second piston is configured to actuate the lock.

11. The running tool assembly of claim 8, wherein the first piston comprises a first seal sealing against the outer surface of the mandrel and a second seal configured to seal against an inner surface of the wellhead housing when the running tool is disposed in the wellhead housing.

12. The running tool assembly of claim 11, wherein the first and second seals of the first piston are configured to restrict fluid flow across the running tool assembly when the running tool assembly is disposed in the wellhead housing and the end of the first piston is pressurized.

13. The running tool assembly of claim 8, further comprising:

a second piston slidably disposed in a central passage of the mandrel and comprising an annular seal that sealingly engages an inner surface of the central passage;

wherein, when the running tool assembly is disposed in the wellhead housing, the second piston is configured to set an axially settable component in response to a pressurization of the central passage of the mandrel, wherein the axially settable component comprises the lock.

14. The running tool assembly of claim 8, wherein the first piston comprises a connector located at an end of the first piston that is configured to decouple from the seal assembly in response to relative rotation between the first piston and the seal assembly.

15. A running tool assembly for installing a seal assembly in a wellhead housing, comprising:

a mandrel configured to couple with a conveyance string such that relative axial movement between the mandrel and the conveyance string is restricted; and a first piston slidably disposed about the mandrel and comprising a j-slot connector located at an end of the first piston that is configured to decouple from the seal assembly in response to relative rotation between the first piston and the seal assembly;

wherein, when the running tool is disposed in the wellhead housing and the first piston is coupled to the seal assembly, the first piston is configured to energize the seal assembly in response to a pressurization of an end of the first piston, wherein the first piston comprises a first seal sealing against an outer surface of the mandrel and a second seal configured to seal against an inner surface of the wellhead housing when the running tool is disposed in the wellhead housing.

16. The running tool assembly of claim 15, further comprising an anti-rotation key extending from an outer surface of the mandrel, wherein the anti-rotation key is received in a slot of the first piston.

17. The running tool assembly of claim 16, wherein the antirotation key is configured to restrict relative rotation while allowing limited relative axial movement between the mandrel and the first piston.

18. The running tool assembly of claim 15, wherein the first and second seals of the first piston are configured to restrict fluid flow across the running tool assembly when the running tool assembly is disposed in the wellhead housing and the end of the first piston is pressurized.

19. The running tool assembly of claim 15, further comprising:

a second piston slidably disposed in a central passage of the mandrel and comprising an annular seal that sealingly engages an inner surface of the central passage;

wherein, when the running tool assembly is disposed in the wellhead housing, the second piston is configured to set an axially settable component in response to a pressurization of the central passage of the mandrel.

20. The running tool assembly of claim 15, wherein the mandrel is defined by an outer surface extending from a first terminal end of the mandrel to a second a terminal end thereof, and wherein the outer surface of the mandrel is configured to receive a shear pin in at least one receptacle formed therein, the shear pin coupling the first piston to the mandrel to restrict relative axial movement.

* * * * *